United States Patent [19]

Berkich

[11] Patent Number: 4,546,677

[45] Date of Patent: Oct. 15, 1985

[54] SLIP-ON SCREWDRIVER RATCHET

[76] Inventor: Ronald S. Berkich, R.D. #1, Leola, Pa. 17540

[21] Appl. No.: 633,351

[22] Filed: Jul. 23, 1984

[51] Int. Cl.[4] ..... B25B 13/46

[52] U.S. Cl. ..... 81/62; 192/43.1

[58] Field of Search ..... 81/62, 63, 63.1, 63.2; 145/75, 76, 77; 192/43.1

[56] References Cited

U.S. PATENT DOCUMENTS

| | | | |
|---|---|---|---|
| 1,049,649 | 1/1913 | Benjamin . | |
| 2,407,558 | 9/1946 | Kress | 192/43.1 |
| 2,503,373 | 4/1950 | Browning et al. | 192/43.1 |
| 2,505,678 | 4/1950 | Kull | 192/43.1 |
| 3,080,900 | 3/1963 | Rosenberg . | |
| 3,330,316 | 7/1967 | MacNeill | 81/62 |
| 3,467,231 | 9/1969 | Haznar | 192/43.1 |
| 3,475,999 | 11/1969 | Roberts et al. | 81/63 |
| 4,210,185 | 7/1980 | Acevedo . | |
| 4,235,269 | 11/1980 | Kraus . | |
| 4,285,375 | 8/1981 | Judson . | |

*Primary Examiner*—James L. Jones, Jr.
*Attorney, Agent, or Firm*—Cushman, Darby & Cushman

[57] ABSTRACT

A slip-on ratcheting drive assembly for a fastener driver, particularly a screwdriver, is adaptable for use with most common screwdrivers, and is versatile. The ratcheting drive assembly is simply moved into operative association with a conventional screwdriver handle. Typically the ratcheting drive assembly includes an outer housing, a socket received within the outer housing and rotatable with respect to it, and a ratchet structure cooperating between the socket and housing to allow ratcheting rotation of the socket with respect to the housing. The socket is held in place within the housing by a releasable locking lever, and at the end of the socket opposite its open end a polygon shaped drive projection is provided. A socket adaptor acting between the ratchet and the socket receives the socket in either of two positions, the first position with the socket open end at the housing open end so that the socket can slip on a conventional screwdriver handle, and the second position wherein the socket drive projection extends outwardly from the housing. The ratchet mechanism preferably comprises a toothed ratchet wheel rotatable about an axis concentric with the socket, and a plurality of two-lobed pawls all mounted for rotation about a common axis of rotation parallel to the axis of rotation of the wheel. A selector knob has a spring attached to it, the spring in contact with pawls. The position of the selector knob determines which of the two lobes of each pawl will be in operative association with the ratchet wheel, so as to control the direction of ratcheting rotation.

19 Claims, 12 Drawing Figures

Fig. 1.
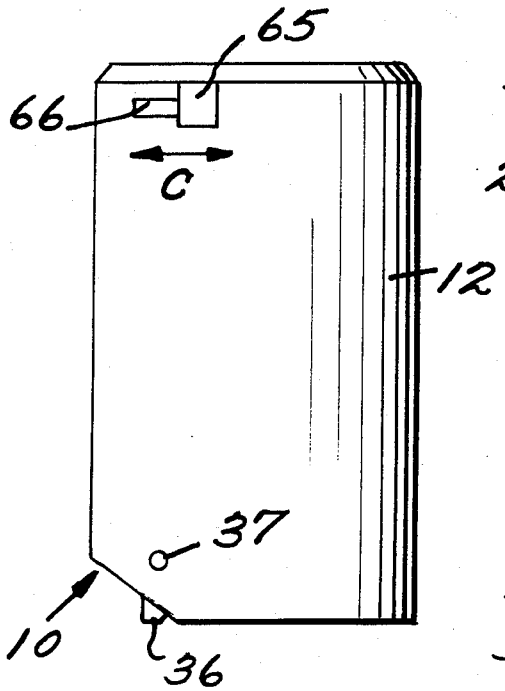
Fig. 4.
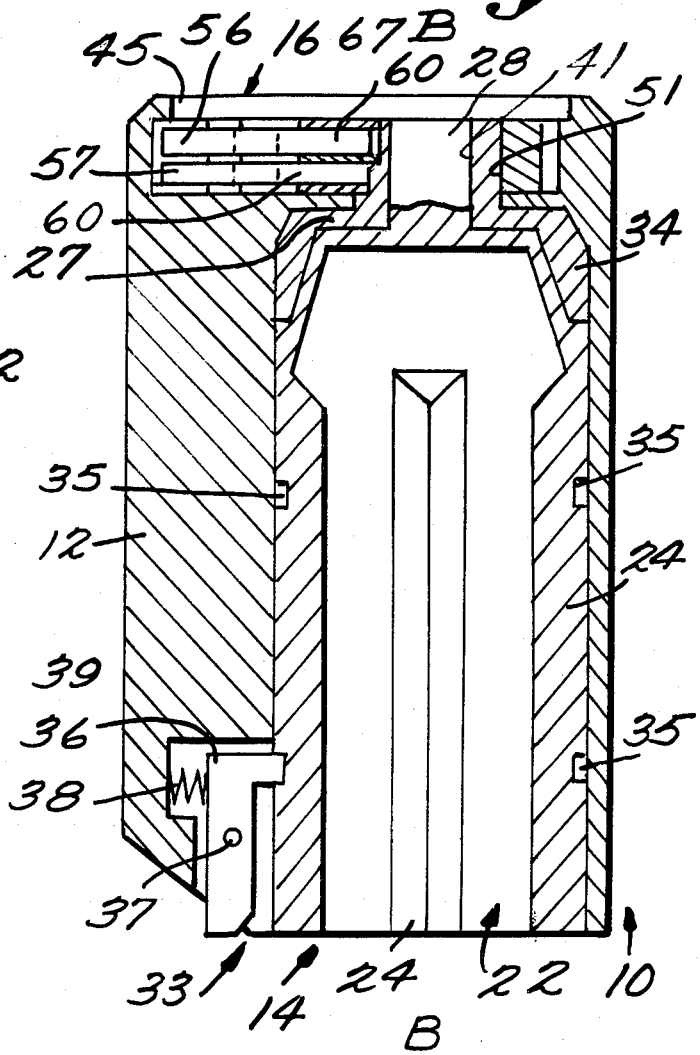
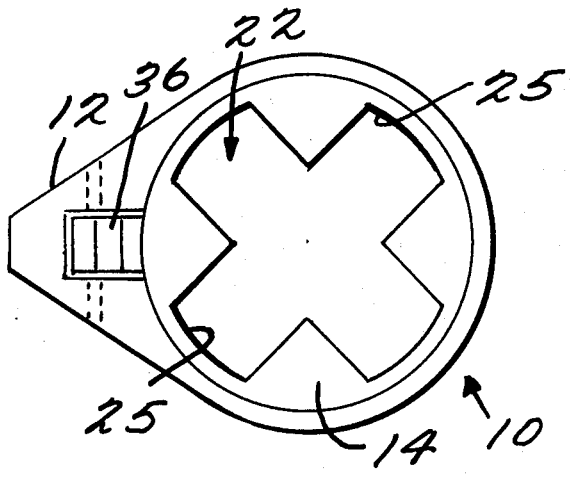
Fig. 2.
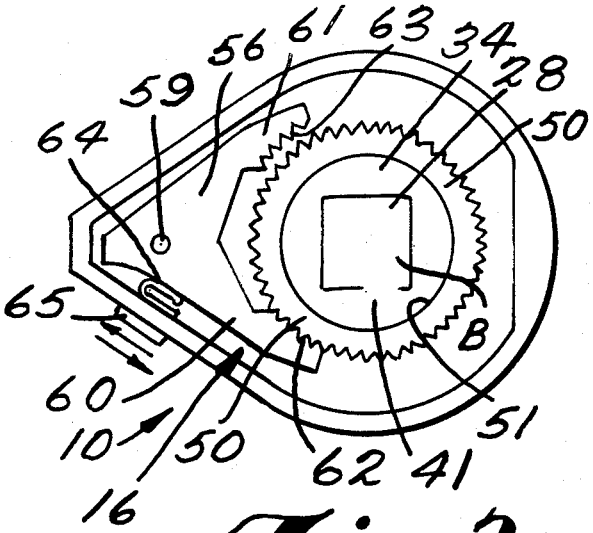
Fig. 3.

SLIP-ON SCREWDRIVER RATCHET

BACKGROUND AND SUMMARY OF THE INVENTION

Ratchet screwdrivers, or other ratcheting mechanisms for fastener drivers such as screwdrivers, nut drivers, and the like, typically are constructed so that the ratcheting mechanism is built directly into the screwdriver, so that the two are sold together, or so that a specialized screwdriver is ncessary in order to cooperate with the ratching assembly.

According to one aspect of the present invention, a drive assembly for a screwdriver is provided that is extremely versatile. The drive assembly according to the invention may be used with a wide variety of conventional screwdrivers that are already on the market. This allows the individual who already has sets of screwdrivers, nut drivers, and the like to merely purchase the driver assembly, and to utilize the driver assembly with a wide variety of such conventional screwdrivers, nut drivers, or the like. The driving assembly according to the invention simply slips over a conventional existing handle of a screwdriver, and thereby quickly and easily changes the conventional screwdriver into a ratcheting screwdriver.

According to another aspect of the present invention, a particular ratchet means is provided, the ratchet means particularly adapted for use with a drive assembly according to the invention. The ratchet means includes a single, toothed ratchet wheel rotatable about an axis of rotation, and a plurality of pawls, each pawl having two toothed lobes. All the pawls are mounted about a common axis of rotation, which is generally parallel to the axis of rotation of the ratchet wheel. A selector knob, with a spring extending therefrom and engaging the pawls, determines which lobe of each pawl is to be biased into operative association with the toothed ratchet wheel, thereby to select a direction of ratcheting rotation. The teeth of adjacent pawls are displaced with respect to each other so as to minimize the amount of rotation between stops of the ratchet wheel for a given tooth spacing of the wheel.

It is the primary object of the present invention to provide for the simple, effective, and versatile ratcheting of a screwdriver or the like. This and other objects of the invention will become clear from an inspection of the detailed description of the invention, and from the appended claims.

BRIEF DESCRIPTION OF THE DRAWINGS

FIG. 1 is a side view of an exemplary drive assembly according to the present invention, for use with a conventional screwdriver or the like;

FIG. 2 is a bottom view of the assembly of FIG. 1;

FIG. 3 is a top view of the assembly of FIG. 1 with the top cover removed;

FIG. 4 is a longitudinal cross-sectional view of the assembly of FIG. 1, with some parts shown in elevation;

DETAILED DESCRIPTION OF THE INVENTION

Figure 5:
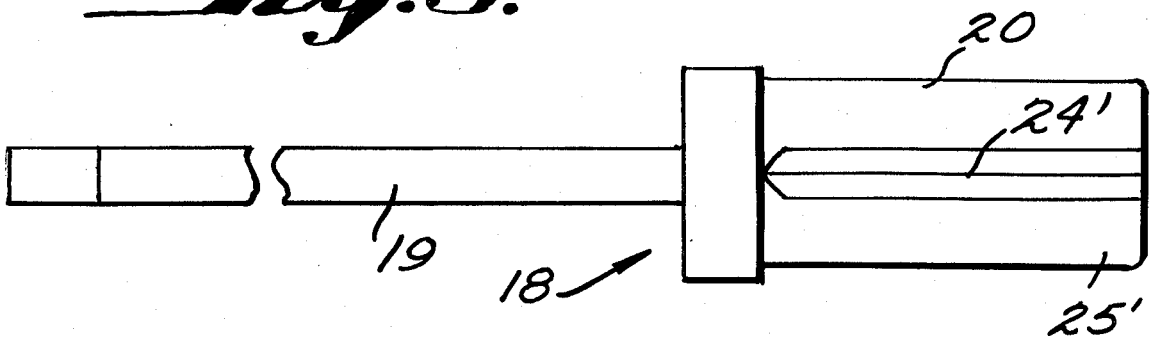
FIG. 5 is a side view of an exemplary conventional screwdriver with which the assembly of FIGS. 1 through 4 is utilizable.
Figure 6:
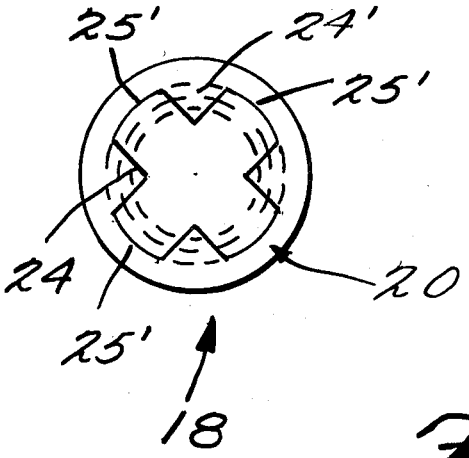
FIG. 6 is a top plan view of the handle of the screwdriver of FIG. 5.

An exemplary drive assembly according to the present invention is shown generally by reference numeral 10 in FIGS. 1 through 4. The assembly 10 includes an outer housing 12, an insert 14 (see FIGS. 4, 9, and 10) received within the housing 12, and ratchet means, shown generally by reference numeral 16 in FIGS. 3 and 4. The drive assembly 10 comprises means for ready removable operative disposition in operative association with the handle of a conventional fastener driver, such as a screwdriver or a nut driver. For instance the assembly 10 is utilizable with a conventional screwdriver 18 illustrated in FIGS. 5 and 6, and including a driver shank 19 integral with a handle 20.

The insert 14 is received within the outer housing 12, and is rotatable with respect to the housing 12 and is dimensioned and shaped to cooperate with the handle 20 so that there is no relative rotation between the insert 14 and handle 20 when the handle 20 cooperates with the insert 14. The ratchet means 16 acts between the housing 12 and the insert 14 for effecting rotation of the insert 14 and the housing 12 together in one direction of rotation, but not the other.

Preferably the insert 14 comprises a socket having an open end 22 thereof adapted to receive the handle 20. The interior of the socket 14 has surface manifestations for cooperating with surface manifestations on the handle 20 so that the two rotate together. Typically cooperating peak and valley surface manifestations are provided in the socket and on the handle. For instance see the peaks 24 and valleys 25 for the socket 14 as illustrated in FIGS. 2 and 4, and the corresponding valleys 24' and peaks 25' of the handle 20. A particularly desirable configuration for the socket interior is generally the form of a Swiss Cross in cross-section, since many, many conventional screwdrivers on the market have a Swiss Cross configuration, as can be seen most clearly in FIG. 6. Note that the Swiss Cross configuration of the socket 14 allows it to effectively cooperate with screwdriver handles 20 having a wide variety of diameters, as exemplied by the dotted line circle segments in FIG. 6.

For enhanced versatility, preferably the insert 14 includes, in addition to the open end 22 thereof, a second, closed end 27 (see FIGS. 4, 9, and 10) opposite the open end 22. The closed end 27 has—extending outwardly therefrom, concentric with the open end 22 and generally along the dimension of elongation A (see FIGS. 9 and 10) of the insert 14—a drive projection 28. The drive projection 28 has a polygonal cross-section (e.g. a square cross-section—see FIG. 3), and is adapted to cooperate with a wide variety of conventional fastener drivers that the open socket end 22 of the insert does not cooperate with. For instance the drive projection 28 may cooperate with the handle 30 (see FIGS. 7 and 8) of another conventional screwdriver or nut driver, the handle 30 having means defining a polygon-cross-section opening 31 in the end thereof. The drive projection 28 fits in the opening 31 to effect driving of the handle 30. Of course the handle 30 can be associated with any conventional fastener driver, nut or bolt receiving socket, or the like.

In order to faciliate changeover of the insert 14 from a first position thereof (FIGS. 4 and 9) wherein the open end 22 faces outwardly from the bottom of the housing 12, to a second position wherein the drive projection 28 extends outwardly from the bottom of the housing 12, the locking lever means 33 and the socket adaptor 34 are provided. One or more grooves 35 (see FIGS. 4, 9, and 10) are provided in a circumferentially continous manner around the exterior surface of the cylindrical insert 14, each groove adapted for cooperation with the locking lever means comprising a locking lever 36 pivoted about a pivot pin 37 with a coil spring 38 or the like spring biasing a locking projection 39 of the lever 36 into operative association with the groove 35. The locking lever means 33 allows relative rotation between the insert 14 and the housing 12 but does not allow removal of the insert 14 from the housing 12 unless the lever 36 is pivoted in a counter-clockwise direction (in FIG. 4) about the pivot pin 37 so that the locking projection 39 is not within the groove 35.

Figure 9:
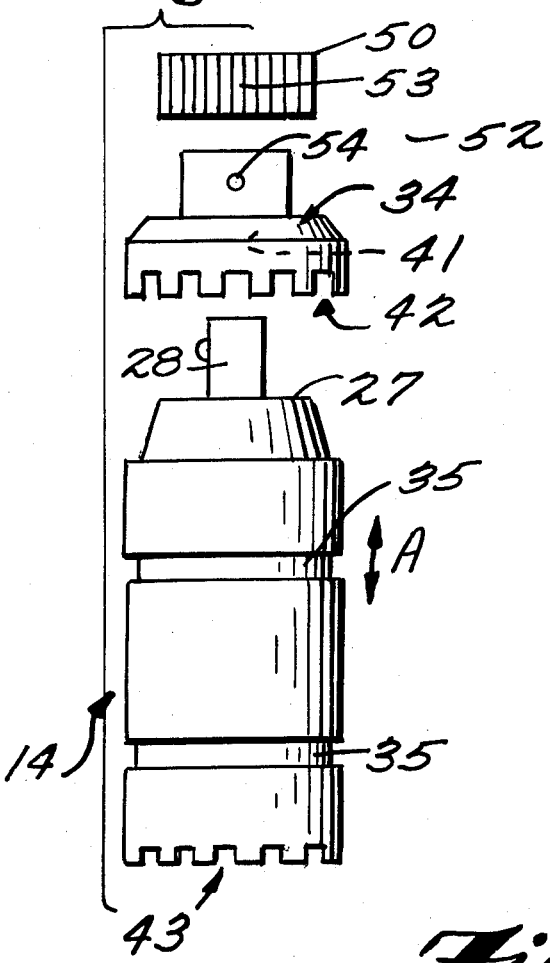
FIG. 9 is an exploded view of interior components of the drive assembly of FIG. 1.
Figure 10:
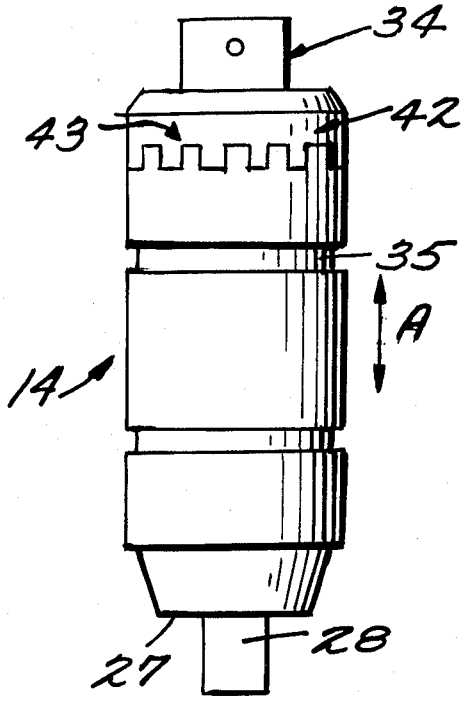
FIG. 10 is a side view of the socket adaptor and socket of FIG. 9 shown in an alternative position thereof.

The socket adaptor 34 provides cooperation between the insert 14 and the ratchet means 16. The socket adaptor 34 has two different surface manifestations associated therewith for cooperation with the insert 14 so as to provide connection of the insert 14 to the ratchet means 16 irrespective of which of the two positions (the FIG. 9 or the FIG. 10 position) in which the insert is disposed. As seen most clearly in FIGS. 3, 4, and 9, the first surface manifestation of the adaptor 34 preferably comprises a concentric bore 41 which has substantially the same cross-sectional shape and dimensions as the drive projection 28. The second surface manifestation of the socket adaptor 34 preferably comprises the castellated edge 42 thereof which is most remote from the ratchet means 16, and is adapted to cooperate with a corresponding castellated edge 43 formed on the first, open, end of the insert 14. Cooperation between the castellated edges 42, 43 is illustrated in FIG. 10.

The housing 12 preferably has an out-of-round configuration, which is adapted to facilitate grasping by a human hand, and maximum torque application. The shape thereof is clearly visible from FIGS. 1 through 3. In addition to having a central bore adapted to receive the insert 14 from the socket adaptor 34, an open top portion (see FIGS. 3 and 4) of the housing is also provided for receipt of the ratchet means 16. Preferably a removable cover 45 covers the open top of the housing 12.

A wide variety of ratchet means 16 may be utilized with the assembly 10. For instance conventional slanted toothed wheels and cooperating pawls (such as shown in U.S. Pat. No. 4,285,375), or conventional roller ratchets, may be provided. One particularly suitable ratchet assembly for use according to the invention is illustrated in FIGS. 3, 4, and 9.

The illustrated ratchet assembly 16 comprises a conventional straight-toothed ratchet wheel 50, made of hard plastic, or other suitable material, and mounted for rotation about an axis B—B, concentric with the insert 14 and adaptor 34. The adaptor 34 is received within an interior bore 51 of the ratchet wheel 50, and suitable means are provided for holding the adaptor 34 and wheel 50 for rotation together. Such means may take the form of a pin 52 (see FIG. 9) passing through aligned openings 53, 54 in the wheel 50 and adaptor 34, respectively. Alternatively, the bore 51 and the exterior surface of the adaptor 34 could both be out-of-round (e.g. square).

The ratchet means 16, as illustrated in FIGS. 3 and 4, also preferably comprises pawl means, preferably a plurality of two-lobed pawls 56, 57. The pawls 56, 57 are mounted for rotation about a common axis of rotation, defined by pivot pin 59 which is generally parallel to the axis B—B. The lobes 60, 61 of each of the pawls 56, 57 has teeth 62, 63, respectively (see FIG. 3) formed thereon for cooperation with the teeth of the wheel 50. The teeth 62, 63 are shaped and dimensioned, and/or the pawls 56, 57 are mounted in a particular relationship with respect to the wheel 50, to allow a ratcheting action.

The direction of ratcheting rotation will be determined by which of the lobes 60, 61 of the pawls 56, etc., is in operative engagement with the wheel 50. Selector means are desirably provided for selecting whether the lobe 60 of each pawl is in engagement with the wheel 50, or the the lobe 61, to thereby determine the direction of ratcheting rotation. The selector means, most clearly illustrated in FIGS. 1 and 4, preferably comprises a selector knob 65 mounted for sliding movement within a groove 66 formed in the side of the housing 12, with a spring means, such as a U-shaped spring steel leaf spring 67, extending therefrom and into biasing engagement with each of the pawls 56, 57. The juxtaposition of the spring 67 with respect to the pawls 56, 57 is seen in FIG. 4. By reciprocating the knob 65 in the dimension C, the engagement of the spring 67 on each of the pawls—e.g. pawl 56—with respect to the pivot pin 59 will change, so that the lobe 60 will be biased into operative engagement with the wheel 50 in one position (as seen in FIG. 3), and the lobe 61 biased into engagement in the other position.

The teeth 62, 63 of the adjacent pawls 56, 57 are offset slightly with respect to each other around the circumference of the wheel 50, and the pawls 56, 57 are spaced from each other in a dimension parallel to the axis B—B. The slight off-set of the teeth 62, 63 of adjacent pawls 56, 57 reduces (i.e. minimizes) the amount of rotation between stops of the wheel 50. Such an arrangement is more desirable than providing smaller teeth and/or teeth spacings for the ratchet wheel 50. Such pawl teeth offset is schematically illustrated in FIG. 4 wherein the lobes 60, 60' of the adjacent pawls 56, 57 have slightly different lengths.

Figure 11:
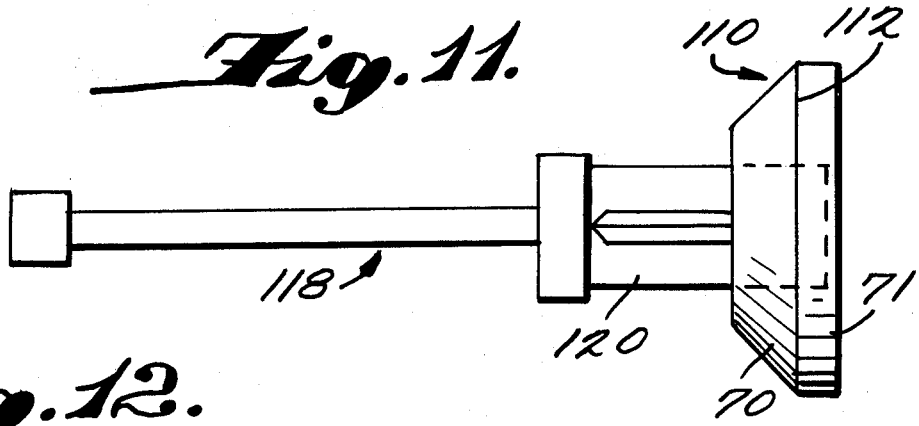
FIG. 11 is a side view of another embodiment of a drive assembly according to the invention shown in operative association with the handle of a nut driver.
Figure 12:
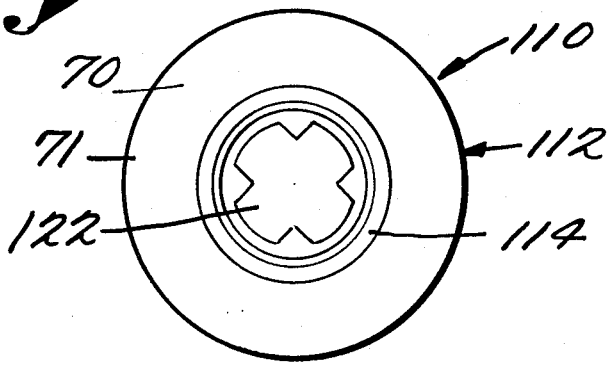
FIG. 12 is a bottom view of the drive assembly of FIG. 11.

In FIGS. 11 and 12, another embodiment of the drive assembly according to the present invention is illustrated. This drive assembly is generally referenced by the reference numeral 110, and includes a housing 112 and an interior socket 114. In this embodiment the socket 114 is not nearly as elongated in the dimension A as that in the FIGS. 1 through 4, 9, and 10 embodiment. Ratchet means are also disposed between the socket 114 and the housing 112 in the FIGS. 11 and 12 embodiment, but such ratchet means are conventional and not illustrated.

The housing 112 of the drive assembly 110 includes a first portion 70 in the shape of a truncated cone, and includes a second portion 71, most remote from the open end 122 of the socket 114, that is substantially cylindrical. The diameter of the cylindrical portion 71 is much greater than the largest cross-sectional dimension of the handle 120 of a conventional nut driver, or the like, adapted to cooperate therewith, and is dimensioned so as to substantially fill the palm of a human hand. This allows the amount of torque to be applied by the device 110 to the tool 118 to be increased.

In a typical manner of utilization of the embodiment of FIGS. 1 through 4, 9, and 10, the insert 14 is received within the housing 12 so that the open end 22 thereof faces outwardly of the housing, and with the locking means 33 holding the insert 14 in place in the housing 12. The operator then merely passes the insert 14 over the handle 20 of a screwdriver, the cooperating surface manifestations 24, 25 of the interior of the insert 14 and the surface manifestations 24', 25' of the handle 20 insuring that rotation of the insert 14 will be translated into rotation of the handle 20. Then the operator selects the desired direction of ratcheting rotation by moving the selector knob 65 to one of two positions, the operator grasps the housing 12, and starts rotating. Rotation of the housing 12 in one direction (e.g. clockwise in FIG. 3) causes the pawls 56, 57 to engage the ratchet wheel 50 so that the ratchet wheel 50, adaptor 34, insert 14, and handle 20 all rotate in that direction, while rotation of the housing 12 in the opposite direction (e.g. counterclockwise in FIG. 3) allows the pawls 56, 57 to move out of engagement with the teeth of the wheel 50 so that relative rotation between the housing 12, wheel 50, and socket adaptor 34 on the one hand, and the insert 14 and handle 20 on the other hand, takes place.

Figure 7:
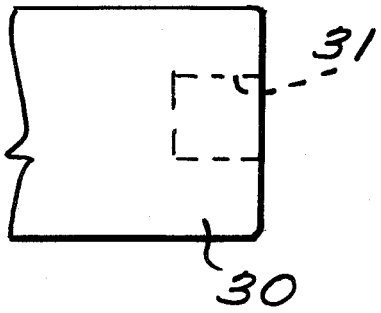
FIG. 7 is a side view of the handle of another type of conventional screwdriver.
Figure 8:
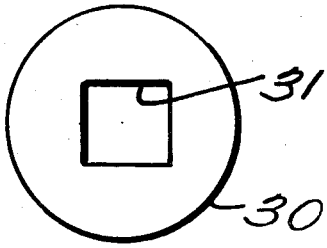
FIG. 8 is a top plan view of the handle of the screwdriver of FIG. 7.

When it is desired to use the assembly 10 with a driver handle such as illustrated in FIGS. 7 and 8, the operator merely pivots the lever 36 against the bias of spring 38 to remove the locking projection 39 from the groove 35, pulls the insert 14 out of the housing 12, turns the insert 180° about an axis perpendicular to the dimension of elongation A thereof, and reinserts the insert 14 into the housing 12. In this position, the castellated edge 43 of the insert 14 (see FIG. 10) moves into engagement with the castellated edge 42 of the adaptor 34, and the locking lever 39 automatically moves into engagement with a groove 35, with the drive projection 28 extending outwardly from the bottom of the housing 12. The drive projection 28 is then inserted in the opening 31 in the handle 30, and ratcheting action is repeated as described above.

It will thus be seen that according to the present invention the simple, effective, and versatile ratcheting of conventional screwdrivers or the like may be provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. In combination:

a fastener driver having a driver shank integral with an elongated handle; and means for ready removable operative disposition with said handle for effecting ratchet action of said handle, said means comprising: an outer housing; an insert received within said outer housing and rotatable with respect to said outer housing, said insert dimensioned and shaped to receive said handle so that there is no relative rotation between said insert and said handle when said handle is engaged by said insert; and ratchet means acting between said housing and said insert for effecting rotation of said insert and said housing together in one direction of rotation, but not the other.

2. In a combination as recited in claim 1, further comprising reversing means for acting on said ratchet means to reverse the direction in which said housing and said insert rotate together, and the direction in which they do not rotate together.

3. In a combination as recited in claim 1 wherein said insert comprises a socket having an open end, said socket dimensioned and shaped so that said handle is disposable in said socket open end so that said socket fits over and receives said handle.

4. In a combination as recited in claim 3 wherein said hanlde has generally a Swiss Cross shape in cross-section, and wherein said socket includes interior wall members also having a Swiss Cross cross-section corresponding to that of said handle.

5. In a combination as recited in claim 4 wherein said outer housing adjacent the open end of said socket has a shape of a truncated cone, and at the end thereof opposite the open end of said housing has an enlarged cylindrical form dimensioned to correspond generally to the size and shape of a human hand palm, said cylindrical portion having a diameter much greater than the largest cross-sectional dimension of said handle.

6. In a combination as recited in claim 3 further comprising a socket adaptor disposed between said socket and said ratchet means, and wherein said socket includes at a second end thereof, opposite the open end thereof, a drive projection having a polygonal cross-section; and wherein said socket adaptor includes first and second surface means, said first surface means cooperating with said socket drive projection when said socket open end is remote from said socket adaptor, and second surface means for cooperating with said socket open end when said socket drive projection is remote from said socket adaptor, and extends outwardly of said housing.

7. In a combination as recited in claim 6 wherein said socket adaptor first surface means comprises a bore for receiving said socket drive projection, said bore having substantially the same cross-sectional shape and dimensions as said socket projection; and wherein said second surface means comprises a castellated edge of said socket adaptor for cooperation with a corresponding castellated edge of said socket open end.

8. In a combination as recited in claim 6 further comprising circumferentially continuous groove means formed on said socket, and latch means mounted in said housing for cooperation with said groove means on said socket so that said releasable latching means holds said socket in said housing in either a first position thereof wherein said socket open end is remote from said socket adaptor, or a second position thereof wherein said socket drive projection extends outwardly from the bottom of said housing, yet said latching means allows relative rotation between said socket and said housing.

9. In a combination as recited in claim 1 wherein said outer housing has a significantly out-of-round cross-section to facilitate ready grasping thereof, and torque application therewith.

10. Apparatus as recited in claim 1 wherein said ratchet means comprises a toothed ratchet wheel mounted concentrically with said insert, and pawl means non-concentrically mounted with respect to said insert, and movable with respect to said housing.

11. In a combination as recited in claim 10 wherein said pawl means comprises a pawl pivotally mounted for rotation with respect to said housing about an axis generally parallel to the axis of rotation of said ratchet wheel, said pawl having first and second lobes, each of said lobes having teeth for cooperation with said toothed ratchet wheel; and selector means, including spring means, for biasing one or the other, but not both, of said pawl lobes into contact with said toothed ratchet wheel with said pawl teeth operatively engaging said ratchet wheel teeth, said selector means engaging said pawl and movable with respect to said pawl to effect control of which of said toothed lobes is in operative contact with said ratchet wheel teeth.

12. In a combination as recited in claim 11 further comprising a plurality of pawls mounted for rotation about said axis of rotation with respect to said housing, said pawls spaced from each other along said axis of rotation, and each of said pawls including toothed lobes wherein the teeth of the lobes of each pawl are slightly spaced from the teeth of the corresponding lobe of an adjacent pawl, so as to effectively minimize the amount of rotation between stops effected by said ratchet means.

13. A drive assembly for cooperation with a fastener driver, said drive assembly comprising:

an outer housing;

an elongated socket received within said outer housing and rotatable with respect to said outer housing, said socket having a first open end thereof, and a substantially closed second end thereof, said socket elongated in a dimension of elongation between said first and second ends, and said socket having formed interiorly thereof, at least adjacent said first open end thereof, peak and valley surface means; and ratchet means acting between said housing and said socket for effecting rotation of said socket and housing together in one direction of rotation, but not the other.

14. A drive assembly as recited in claim 13 wherein said outer housing has a significantly out-of-round cross-section to facilitate ready grasping thereof, and torque application therewith.

15. A drive assembly as recited in claim 13 wherein said peak and valley surface means comprises means defining a generally Swiss-Cross shaped cross-sectional opening.

16. A drive assembly as recited in claim 13 further comprising a socket adaptor disposed between said socket and said ratchet means, and wherein said socket includes at a second end thereof, opposite the open end thereof, a drive projection having a polygonal cross-section; and wherein said socket adaptor includes first and second surface means, said first surface means cooperating with said socket drive projection when said socket open end is remote from said socket adaptor, and second surface means for cooperating with said socket open end when said socket drive projection is remote from said socket adaptor, and extends outwardly of said housing.

17. A drive assembly as recited in claim 16 further comprising circumferentially continuous groove means formed on said socket, and latch means mounted in said housing for cooperation with said groove means on said socket so that said releasable latching means holds said socket in said housing in either a first position thereof wherein said socket open end is remote from said socket adaptor, or a second position thereof wherein said socket drive projection extends outwardly from the bottom of said housing, yet said latching means allows relative rotation between said socket and said housing.

18. A drive assembly as recited in claim 16 wherein said ratchet means comprises a toothed ratchet wheel having a central bore receiving said socket adaptor therein, said socket adaptor removably mounted for rotation together about an axis concentric with said socket and along the dimension of elongation thereof; and wherein said ratchet means further comprises pawl measn comprising at least one pawl having a pair of toothed lobes and mounted for pivotal movement with respect to said housing about an axis generally parallel to the axis of rotation of said ratchet wheel; and selector means, including spring means, for selectively biasing one of said pawl lobes into operative engagement with said ratchet wheel while the other of said ratchet lobes is spaced from operative association with said ratchet wheel.

19. A ratcheting assembly comprising:

a toothed ratchet wheel mounted for rotation about an axis of rotation;

pawl means comprising a plurality of pawls, each pawl having a pair of toothed lobes, the teeth of said lobes for operative cooperation with the teeth of said ratchet wheel;

pivot means for pivotally mounting each of said pawls for pivotal movement about a common axis, said axis being generally parallel to the axis of rotation of said ratchet wheel, and said pawls spaced from each other in a dimension parallel to the axis of rotation of said ratchet wheel; the teeth formed on the lobes of the different pawls being displaced with respect to the teeth of another pawl so as to minimize the amount of rotation between stops of the ratchet wheel; and selector means, including spring means, for operatively engaging said pawls to selectively determine which lobe of each of said pawls will be in operative association with said toothed ratchet wheel, and which lobe of each pawl will be spaced from operative association with said ratchet wheel.

* * * * *